US009041609B2

(12) United States Patent
Miller et al.

(10) Patent No.: US 9,041,609 B2
(45) Date of Patent: May 26, 2015

(54) THIN-FILM ANTENNA WITH POWER-LIMITING FUSE

(71) Applicants: Alan Miller, Milan, MI (US); Oliver Neil, Commerce Township, MI (US)

(72) Inventors: Alan Miller, Milan, MI (US); Oliver Neil, Commerce Township, MI (US)

(73) Assignee: HIRSCHMANN CAR COMMUNICATION GMBH, Neckartenzlingen (DE)

( * ) Notice: Subject to any disclaimer, the term of this patent is extended or adjusted under 35 U.S.C. 154(b) by 189 days.

(21) Appl. No.: 13/680,240

(22) Filed: Nov. 19, 2012

(65) Prior Publication Data

US 2013/0135175 A1 May 30, 2013

Related U.S. Application Data

(60) Provisional application No. 61/564,321, filed on Nov. 29, 2011.

(51) Int. Cl.

| | |
|---|---|
| ***H01Q 1/24*** | (2006.01) |
| ***H01Q 1/00*** | (2006.01) |
| ***H01Q 1/50*** | (2006.01) |
| ***H01Q 1/32*** | (2006.01) |
| ***H01Q 1/38*** | (2006.01) |

(52) U.S. Cl.
CPC ..... *H01Q 1/50* (2013.01); *H01Q 1/3216* (2013.01); *H01Q 1/3275* (2013.01); *H01Q 1/38* (2013.01)

(58) Field of Classification Search
USPC ..... 343/906
See application file for complete search history.

*Primary Examiner* — Graham Smith
(74) *Attorney, Agent, or Firm* — Andrew Wilford

(57) ABSTRACT

An antenna has a radiator formed entirely of thin film and adapted to receive and transmit radio-frequency signals, a connector also formed of thin film and adapted for connection to a transmitter, and a fuse formed of the same thin film as the radiator and connector and connected therebetween. The fuse is of a narrower width than the antenna and connector parts and so dimensioned as to melt if a radio-frequency signal greater than a predetermined magnitude is transmitted through it from the connector part to the radiator part.

3 Claims, 1 Drawing Sheet

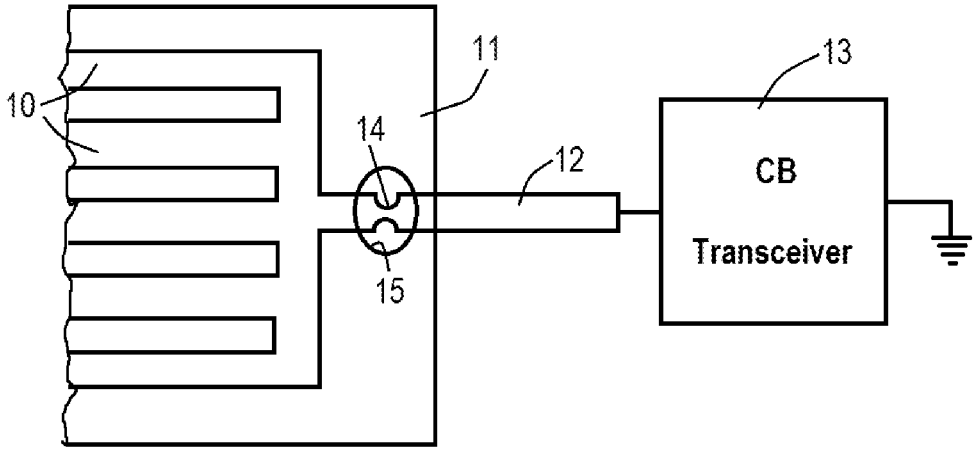
10
11
12
13
14
15
CB
Transceiver

THIN-FILM ANTENNA WITH POWER-LIMITING FUSE

CROSS REFERENCE TO RELATED APPLICATION

This case is the replacement of provisional application 61/564,321 filed 29 Nov. 2011.

FIELD OF THE INVENTION

The present invention relates to a thin-film antenna.

BACKGROUND OF THE INVENTION

Most CB antennas mounted on Class 8 trucks (semis) in North America are rod antennas typically greater than 1 m in length mounted either on the side-view mirrors or on the sides of the cabin.

Hirschmann Car Communication has developed a thin film CB antenna by printing silver material on PET film that can be mounted inside the vehicle between the headliner and the SMC (fiberglass) roof structure of these trucks.

The legal power limit for CB transmitters is 4 watts. However, drivers sometimes install power amplifiers ranging from 60 watts to over 1000 watts in an attempt to improve their range.

The vehicle manufacturer is concerned that one of these high power amplifiers might be used with the thin film antenna and excessive heat buildup might result in smoke or fire in the cabin.

OBJECT OF THE INVENTION

It is therefore the object of this invention to provide a way of protecting such a thin-film antenna from overload.

SUMMARY OF THE INVENTION

Testing was conducted on 12 Jul. 2011 to measure the temperature reached by the antenna when high power levels were applied to it. During the testing an RF fuse was developed to prevent the antenna from reaching excessive temperatures. An RF fuse was developed on the antenna structure a short distance from the feed point. It was designed by narrowing the trace to form a high resistance point on the film that would melt when excessive power was applied resulting in an open circuit.

BRIEF DESCRIPTION OF THE DRAWING

The sole FIGURE of the drawing is a schematic representation of the invention.

DETAILED DESCRIPTION

A CB antenna has a radiator 10 intended to transmit and receive radio-frequency signals and imbedded in a PET film

11. A connector 12 formed of the a silver film that forms the radiator 10 and unitary therewith extends from the radiator outside the film 11 to a CB transceiver 13 to transmit radio signals between the transceiver and the radiator part. The PET film actually comprises a lower film layer used to adhere the antenna to a vehicle body part and an upper film layer that mechanically protects the delicate and very thin silver layer forming the radiator 10. The connector has a region 15 of substantially reduced cross section forming a fuse.

The region 15 forming the fuse is exposed in a hole 14 in one or both of the protective film layers and has a diameter of about 10 mm as tests have shown that a fuse covered by a lamination blows at much higher power levels and potentially ignites the adhesive used in the lamination or the lamination material itself.

While the fuse was developed for the CB frequency band, the fuse can also be used in other frequency bands.

The antenna according to the invention has several advantages:

1. The fuse part prevents the antenna from overheating and potentially causing smoke or fire.

2. The fuse prevents illegal/dangerous use that might result in excessive radiation exposure to occupants and others nearby.

3. The cost of the fuse is low since it is integrated into the antenna rather than being a separate component that is added to the cable.

4. Elimination of the fuse for use of the antenna with a power booster is largely impossible without destroying the antenna.

5. The power level of the fuse is easily adjusted by changing its width, presuming its thickness is the same as the film of the radiator part and connector part.

I claim:

1. An antenna comprising:

a radiator formed entirely of a thin film and adapted to receive and transmit radio-frequency signals;

a connector formed of the same thin film as the radiator and adapted for connection to a transmitter;

a fuse formed integrally of the same thin film as the radiator and connector and connected therebetween, the fuse being of a narrower width than the antenna and connector and so dimensioned as to melt if a radio-frequency signal greater than a predetermined magnitude is transmitted through it from the connector to the radiator; and a dielectric plastic sheet in which the radiator is imbedded, the fuse not being imbedded in the sheet such that the thin film is wholly exposed at the fuse.

2. The antenna defined in claim 1, wherein the sheet is formed by a pair of layers, the radiator being between the layers.

3. The antenna defined in claim 1 wherein the connector is at least partially imbedded in the sheet and the sheet is cut away around the fuse to expose it.

* * * * *